US007705797B2

(12) United States Patent
Philippakis

(10) Patent No.: US 7,705,797 B2
(45) Date of Patent: Apr. 27, 2010

(54) ANTENNA ARRANGEMENT

(75) Inventor: Michael Philippakis, Coombe (GB)

(73) Assignee: ITI Scotland Limited, Glasgow (GB)

( * ) Notice: Subject to any disclaimer, the term of this patent is extended or adjusted under 35 U.S.C. 154(b) by 0 days.

(21) Appl. No.: 11/773,222

(22) Filed: Jul. 3, 2007

(65) Prior Publication Data

US 2008/0122728 A1 May 29, 2008

(30) Foreign Application Priority Data

Jul. 7, 2006 (GB) ..... 0613599.0

(51) Int. Cl.
*H01Q 19/00* (2006.01)

(52) U.S. Cl. ..... 343/833; 343/815; 343/876

(58) Field of Classification Search ..... 343/815, 343/817, 818, 833, 834, 876
See application file for complete search history.

(56) References Cited

U.S. PATENT DOCUMENTS

| | | | |
|---|---|---|---|
| 5,293,172 | A | 3/1994 | Lamberty et al. |
| 5,424,737 | A | 6/1995 | Lindell |
| 2002/0105471 | A1 | 8/2002 | Kojima et al. |
| 2005/0035910 | A1 | 2/2005 | Chiang et al. |
| 2005/0162327 | A1 | 7/2005 | Mori |
| 2005/0206573 | A1 | 9/2005 | Iigusa et al. |

FOREIGN PATENT DOCUMENTS

| | | | |
|---|---|---|---|
| EP | 1 511 119 | A1 | 3/2005 |
| GB | 1 021 727 | A | 3/1966 |
| GB | 1021727 | | 3/1966 |
| WO | WO01/56189 | A1 | 8/2001 |
| WO | WO 2005/093904 | A | 10/2005 |

OTHER PUBLICATIONS

U.K. Search Report dated Oct. 25, 2006.
Preston S et al.: A Multibeam Antenna Using Switched Parasitic and Switched Active Elements for Space-Division Multiple Access Applications: IEICE Transactions on Electronics, Electronics Society, Tokyo, JP, vol. E82-C, No. 7, Jul. 1999, pp. 1202-1210, XP000930455 ISSN: 0916-8524 paragraph [002.]-paragraph [003.]; figure 5.
International Search Report Dated Oct. 8, 2007.

*Primary Examiner*—Tho G Phan
(74) *Attorney, Agent, or Firm*—Paul, Hastings, Janofsky & Walker LLP

(57) ABSTRACT

There is provided an antenna arrangement for use in an ultra-wideband network, the antenna arrangement comprising an active element; and a plurality of passive elements arranged around the active element; each passive element being controllable to selectively reflect or transmit radio signals emitted by the active element so as to create a desired beam pattern from the active element.

24 Claims, 4 Drawing Sheets

ANTENNA ARRANGEMENT

TECHNICAL FIELD OF THE INVENTION

The invention relates to an antenna arrangement for a communication system, and in particular relates to an antenna arrangement for use in an ultra wideband (UWB) wireless communication system.

BACKGROUND TO THE INVENTION

Ultra-wideband is a radio technology that transmits digital data across a very wide frequency range, 3.1 to 10.6 GHz. It makes use of ultra low transmission power, typically less than −41 dBm/MHz, so that the technology can literally hide under other transmission frequencies such as existing Wi-Fi, GSM and Bluetooth. This means that ultra-wideband can co-exist with other radio frequency technologies. However, this has the limitation of limiting communication to distances of typically 5 to 20 metres.

There are two approaches to UWB: the time-domain approach, which constructs a signal from pulse waveforms with UWB properties, and a frequency-domain modulation approach using conventional FFT-based Orthogonal Frequency Division Multiplexing (OFDM) over Multiple (frequency) Bands, giving MB-OFDM. Both UWB approaches give rise to spectral components covering a very wide bandwidth in the frequency spectrum, hence the term ultra-wideband, whereby the bandwidth occupies more than 20 percent of the centre frequency, typically at least 500 MHz.

These properties of ultra-wideband, coupled with the very wide bandwidth, mean that UWB is an ideal technology for providing high-speed wireless communication in the home or office environment, whereby the communicating devices are within a range of 20 m of one another.

FIG. 1 shows the arrangement of frequency bands in a Multi Band Orthogonal Frequency Division Multiplexing (MB-OFDM) system for ultra-wideband communication. The MB-OFDM system comprises fourteen sub-bands of 528 MHz each, and uses frequency hopping every 312 ns between sub-bands as an access method. Within each sub-band OFDM and QPSK or DCM coding is employed to transmit data. It is noted that the sub-band around 5 GHz, currently 5.1-5.8 GHz, is left blank to avoid interference with existing narrowband systems, for example 802.11a WLAN systems, security agency communication systems, or the aviation industry.

The fourteen sub-bands are organized into five band groups, four having three 528 MHz sub-bands, and one band group having two 528 MHz sub-bands. As shown in FIG. 1, the first band group comprises sub-band 1, sub-band 2 and sub-band 3. An example UWB system will employ frequency hopping between sub-bands of a band group, such that a first data symbol is transmitted in a first 312.5 ns duration time interval in a first frequency sub-band of a band group, a second data symbol is transmitted in a second 312.5 ns duration time interval in a second frequency sub-band of a band group, and a third data symbol is transmitted in a third 312.5 ns duration time interval in a third frequency sub-band of the band group. Therefore, during each time interval a data symbol is transmitted in a respective sub-band having a bandwidth of 528 MHz, for example sub-band 2 having a 528 MHz baseband signal centred at 3960 MHz.

The technical properties of ultra-wideband mean that it is being deployed for applications in the field of data communications. For example, a wide variety of applications exist that focus on cable replacement in the following environments:

- communication between PCs and peripherals, i.e. external devices such as hard disc drives, CD writers, printers, scanner, etc.
- home entertainment, such as televisions and devices that connect by wireless means, wireless speakers, etc.
- communication between handheld devices and PCs, for example mobile phones and PDAs, digital cameras and MP3 players, etc.

The antenna arrangements used in ultra-wideband systems are usually omni-directional, meaning that radio signals are emitted in all directions from an active radiating element, or elements. However, it is desirable to be able to alter the profile of the emitted radio signals so that they are emitted from the antenna arrangement in a particular direction or directions. In addition, it is desirable to be able to switch an antenna arrangement with more than one active radiating element from an omni-directional mode to a mode in which the antenna arrangement serves a number of different sectors.

By directing the emitted radio signals in a particular direction or directions, interference with other nearby communication links can be reduced, thereby allowing the capacity of the communication system (in terms of the number of possible communication links) to be increased.

Although fixed beam directional antennas are known, for example, horns, reflector or planar linear and conformal arrays based on a plurality of active radiating elements each of which is individually fed and appropriately phased these fixed conventional arrangements can only provide a limited range of coverage with the directed beam. Furthermore, in these conventional arrangements the direction of the beam cannot be switched particularly quickly. A number of directional beam technologies suffer from the limitation that the width of the main peak of the radiated beam depends on the wavelength of the radio signals emitted. Phased arrays based on a plurality of individually fed (with tailored distribution in amplitude and phase) active elements can in principle provide adjustable beams in shape and angular position. However, these antennas are unacceptably expensive. In addition, the state of the art of these antennas suggest that these structures will be less capable of covering the UWB bandwidth, primarily due to mutual coupling or grating lobe problems. Thus, these conventional antenna arrangements are not particularly suitable for use in ultra-wideband systems intended for consumer electronic applications.

It is therefore an object of the invention to provide a directional antenna arrangement for use in an ultra-wideband system that overcomes the problems with the above conventional systems.

SUMMARY OF THE INVENTION

According to a first aspect of the invention, there is provided an antenna arrangement for use in an ultra-wideband network. The antenna arrangement comprises an active element, and a plurality of passive elements arranged around the active element. Each passive element is controllable to selectively reflect or transmit radio signals emitted by the active element so as to create a desired beam pattern from the active element.

According to another aspect of the present invention, there is provided an antenna arrangement for use in an ultra-wideband network. The antenna arrangement comprises an active element, and a plurality of passive elements arranged around the active element. Each passive element is controllable to selectively reflect or transmit incident radio signals so as to direct radio signals from a desired direction or directions towards the active element.

BRIEF DESCRIPTION OF THE DRAWINGS

For a better understanding of the present invention, and to show more clearly how it may be carried into effect, reference will now be made, by way of example only, to the following drawings in which.

DETAILED DESCRIPTION OF THE PREFERRED EMBODIMENTS

Although the invention will be described further herein as relating to use in an ultra wideband network, it will be appreciated that the invention can be adapted for use in other types of network.

Figure 2:
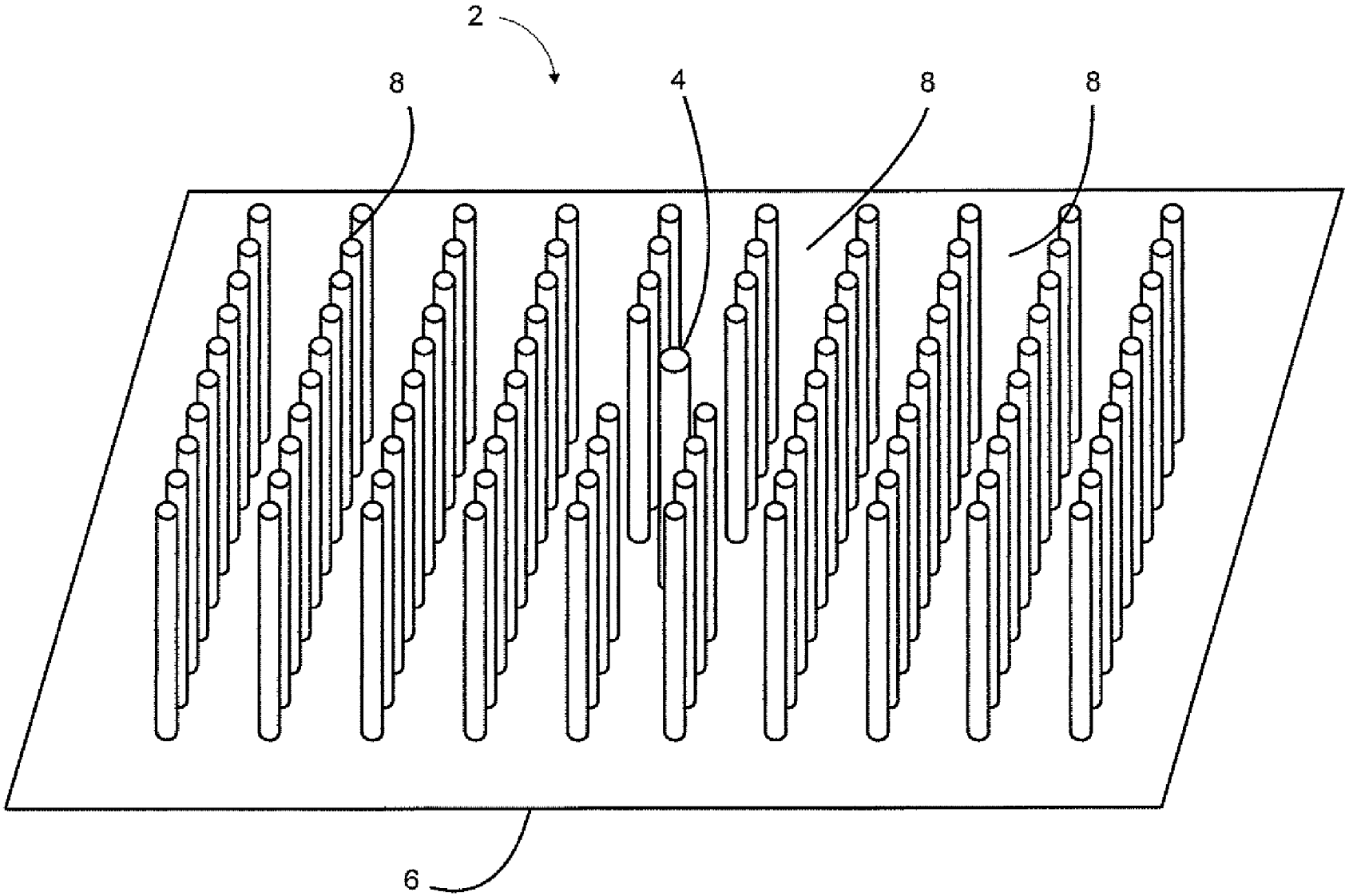
FIG. 2 is a perspective view of an antenna arrangement in accordance with an embodiment of the invention.
Figure 3:
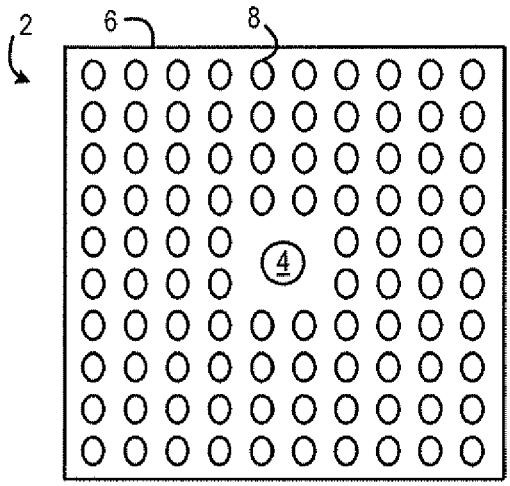
FIG. 3 is a top view of the antenna arrangement of FIG. 2, with the passive elements in a first configuration.

FIG. 2 is a perspective view of an antenna arrangement 2 in accordance with an embodiment of the invention. FIG. 3 is a top view of the antenna arrangement 2 of FIG. 2. The antenna arrangement 2 comprises an active element 4 mounted on a base portion 6. In this exemplary embodiment, the active element 4 is in the form of a monopole, although other forms of element could be used. For example, the active element 4 may comprise several distinct components.

The active element 4 is connected to transmitter circuitry (not shown) which provides the signals to be emitted by the active element 4. The active element 4 can alternatively be connected to receiver circuitry if the antenna arrangement 2 is to be used for receiving radio signals, or to transceiver circuitry if the antenna arrangement 2 is to be used for transmitting and receiving radio signals.

The antenna arrangement 2 further comprises a plurality of passive elements 8 provided on the base portion 6 around the active element 4. In this embodiment, there are 96 passive elements 8 arranged in ten rows and ten columns, with the active element 4 located in the middle of the array. However, it will be appreciated that any number of passive elements 8 can be arranged in any other suitable two- or three-dimensional configuration.

Figure 1:
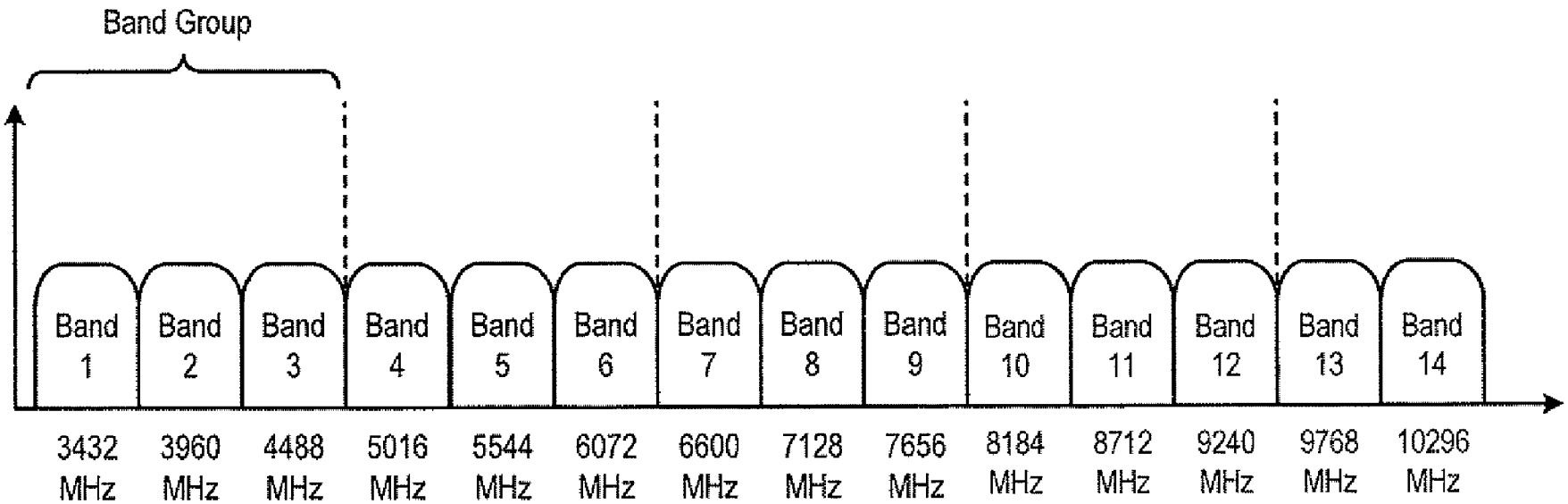
FIG. 1 shows the multi-band OFDM alliance (MBOA) approved frequency spectrum of a MB-OFDM system.

Each passive element 8 is controllable so that it can selectively transmit or reflect radio signals. A passive element 8 'transmits' radio signals in the sense that the passive element 8 is transparent to incident radio signals, i.e. incident radio signals pass through the passive element 8 without being reflected or substantially distorted. Each passive element 8 can be controllable to selectively transmit or reflect signals in a particular band or band group in FIG. 1, or may be controllable to selectively transmit or reflect signals across the whole radio spectrum used for ultra-wideband.

In FIGS. 3 to 7, the passive elements 8 are represented by circles; with a hollow circle '○' indicating that the passive element 8 is controlled so as to transmit radio signals at least in a desired band, and a filled-in circle '●' indicating that the passive element 8 is controlled so as to reflect radio signals at least in the desired band.

In FIG. 3, the passive elements 8 are all controlled so that they transmit radio signals. In this configuration, when the active element 4 emits radio signals, the antenna arrangement 2 forms an omni-directional antenna, as the radio signals can propagate out from the active element 4 in all directions without being reflected by any of the passive elements 8. Conversely, when the active element 4 is for receiving radio signals, the configuration of the passive elements 8 allows signals to be received from all directions.

Figure 4:
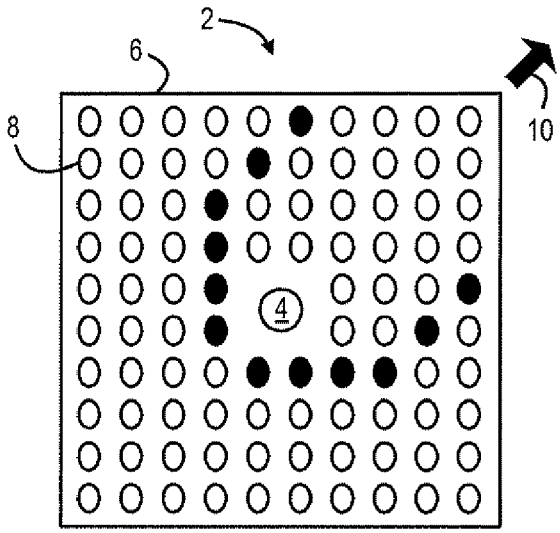
FIG. 4 is a top view of the antenna arrangement of FIG. 2, with the passive elements in a second configuration.

In FIG. 4, a plurality of passive elements 8 in the antenna arrangement 2, for example twelve passive elements 8, are controlled so that they reflect radio signals. The twelve passive elements 8 are in specific positions so that they form a parabolic reflector profile around the active element 4. When the active element 4 emits radio signals in the desired band, the radio signals are primarily reflected in the direction indicated by arrow 10. A parabolic reflector profile as shown in FIG. 4 results in a focused beam in the desired direction. Conversely, when the active element 4 is for receiving radio signals, the configuration of the twelve selected passive elements 8 allows only radio signals from a particular direction to be received.

Figure 5:
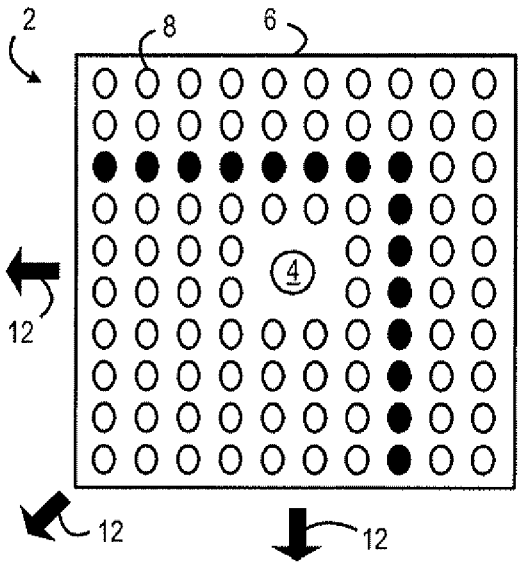
FIG. 5 is a top view of the antenna arrangement of FIG. 2, with the passive elements in a third configuration.

In FIG. 5, a plurality of passive elements 8 in the antenna arrangement 2, for example fifteen, are controlled so that they reflect radio signals. The fifteen passive elements 8 are in specific positions so that they form a corner reflector profile around the active element 4. When the active element 4 emits radio signals in the desired band, the radio signals are reflected in the directions indicated by arrows 12. Conversely, when the active element 4 is for receiving radio signals, the configuration of the fifteen selected passive elements 8 allows radio signals from a particular sector to be received.

Figure 6:
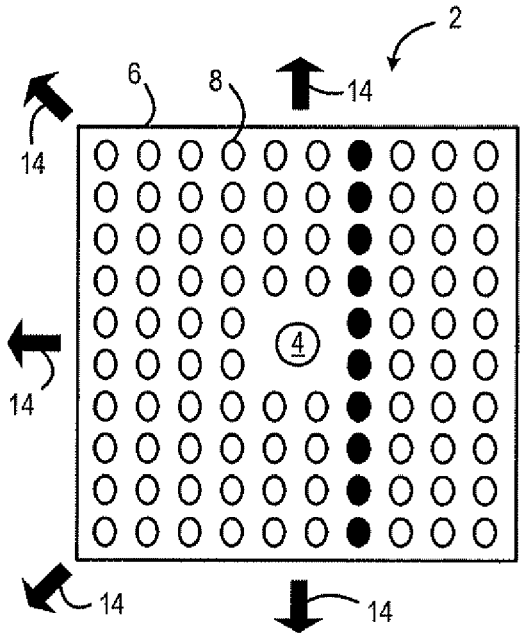
FIG. 6 is a top view of the antenna arrangement of FIG. 2, with the passive elements in a fourth configuration.

In FIG. 6, ten passive elements 8 in the antenna arrangement 2 are controlled so that they reflect radio signals. The ten passive elements 8 are in specific positions so that they form a straight reflector profile to one side of the active element 4. When the active element 4 emits radio signals in the desired band, the radio signals are reflected in the directions indicated by arrows 14. Conversely, when the active element 4 is for receiving radio signals, the configuration of the ten selected passive elements 8 allows radio signals from a particular sector to be received.

Figure 7:
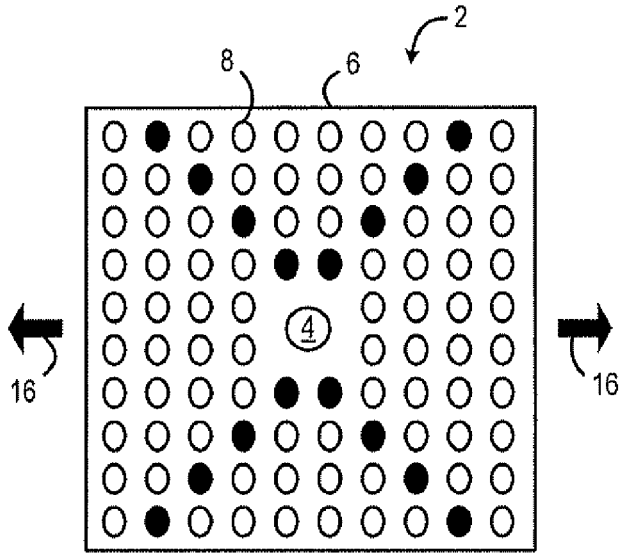
FIG. 7 is a top view of the antenna arrangement of FIG. 2, with the passive elements in a fifth configuration.

In FIG. 7, sixteen passive elements 8 in the antenna arrangement 2 are controlled so that they reflect radio signals. The sixteen passive elements 8 are in specific positions so that they form a reflector profile in the form of an 'X', with the active element 4 at the centre of the 'X'. When the active element 4 emits radio signals in the desired band, the radio signals are reflected broadly in the two directions indicated by arrows 16. Conversely, when the active element 4 is for receiving radio signals, the configuration of the sixteen selected passive elements 8 allows radio signals from two particular sectors to be received.

Provided that there are a sufficient number of passive elements 8 in the antenna arrangement 2, any desired reflector profile can be formed by controlling the appropriate passive elements 8 to reflect the radio signals.

As described above, each passive element 8 is formed from a material or materials that allows the passive element 8 to be controlled between a state in which the element reflects radio signals and a state in which the element transmits radio signals. In a preferred embodiment, each passive element 8 can be formed from polymer rods.

These polymer rods may comprise polyaline or polypyrrole-based plastic composites, although it will be appreciated that other polymer rods, or rods made from other materials can also be used. In addition, the passive elements 8 can be synthetically formed based on individually energized plasma columns.

Preferably, the passive element 8 can be controlled from the reflective state to the transmissive state and vice versa using an electric current. This allows the passive element 8 to be switched rapidly between the two states, which means that the reflector profile formed by the passive elements 8 in the reflective state can be changed rapidly.

Alternatively, high and low reflectivity in a passive element 8 can be implemented by providing a small number of switches distributed around its length, so as by changing the energized length of the element 8, the associated reflectivity can be adjusted. It will be appreciated that when the energized length of a conductive passive element 8 is less than a quarter of the wavelength of the incident radiation (at the highest frequency in the band), the element 8 is in principle transparent to incoming radiation, whereas when the energized length is much greater than a quarter of the wavelength, the element 8 acts as a substantial reflector of the incident radiation.

Figure 8:
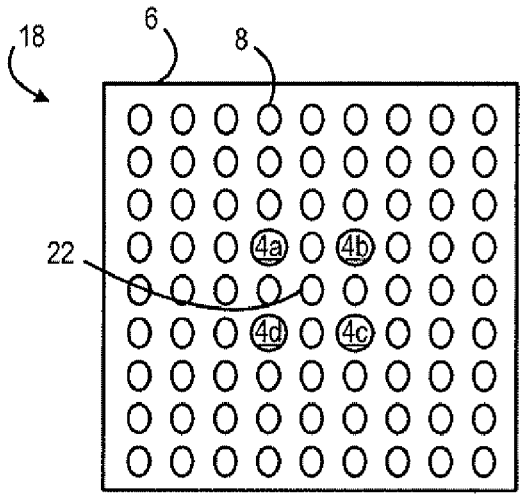
FIG. 8 is a top view of an antenna arrangement in accordance with an alternative embodiment of the invention, with the passive elements in a first configuration.
Figure 9:
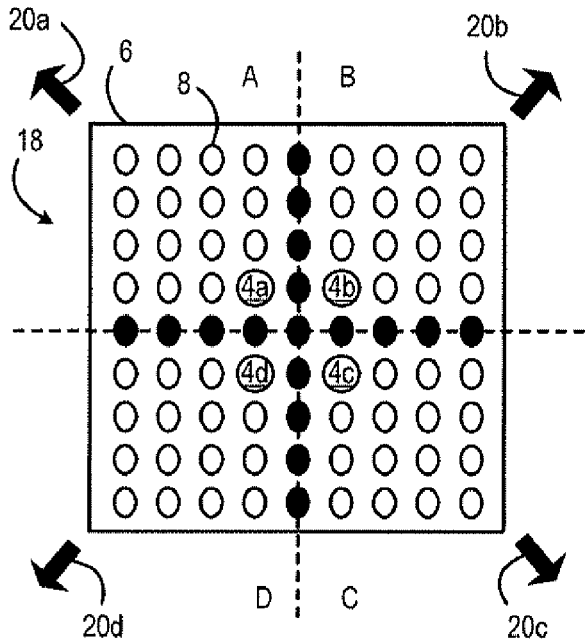
FIG. 9 is a top view of the antenna arrangement of FIG. 8, with the passive elements in a second configuration.

FIGS. 8 and 9 show a top view of an antenna arrangement 18 according to an alternative embodiment of the invention. In this embodiment, the antenna arrangement 18 comprises an active element 4 having four separate components 4*a*, 4*b*, 4*c* and 4*d*, mounted on a base portion 6. The active element components 4*a*, 4*b*, 4*c* and 4*d* can be controlled to act as a single active element (i.e. when the active element emits radio signals, each component 4*a*, 4*b*, 4*c* and 4*d* emits the same signal) or can be controlled individually (i.e. when the active element emits radio signals, each component 4*a*, 4*b*, 4*c* and 4*d* emits a respective signal) or can be controlled as distinct groups (e.g. when the active element emits radio signals, components 4*a* and 4*b* both emit a first signal, whilst components 4*c* and 4*d* both emit a second signal).

The antenna arrangement 18 further comprises a plurality of passive elements 8 provided on the base portion 6 around the active element components 4*a*, 4*b*, 4*c* and 4*d*. Again, the passive elements 8 are represented by circles with a hollow circle '○' indicating that the passive element 8 is controlled so as to transmit radio signals at least in a desired band, and a filled-in circle '●' indicating that the passive element 8 is controlled so as to reflect radio signals at least in the desired band.

In this illustrated embodiment, there are 77 passive elements 8 arranged in nine rows and nine columns, with the active element components 4*a*, 4*b*, 4*c* and 4*d* located near to the middle of the array. At least one passive element (elements 22 in FIG. 8) lies between some or all of the active element components 4*a*, 4*b*, 4*c* and 4*d*.

It will of course be appreciated that any number of passive elements 8 can be arranged in any other suitable two- or three-dimensional configuration.

As above, each passive element 8 is controllable so that it can selectively transmit or reflect radio signals.

In FIG. 8, the passive elements 8 are all controlled so that they transmit radio signals. In this configuration, when at least one of the active element components 4*a*, 4*b*, 4*c* and 4*d* emits radio signals, the antenna arrangement 18 forms an omni-directional antenna, as the radio signals can propagate out from the active element 4 in all directions without being reflected by any of the passive elements 8. Conversely, when the active element 4 is for receiving radio signals, the configuration of the passive elements 8 allows signals to be received from all directions.

However, the antenna arrangement 18 can also be used in a multi-sector configuration. In this case, the active element components 4*a*, 4*b*, 4*c* and 4*d* are controlled individually or as at least two distinct groups. In FIG. 9, there are four different sectors, each served by a respective component 4*a*, 4*b*, 4*c* or 4*d*. Seventeen passive elements 8 in the antenna arrangement 18 are controlled so that they reflect radio signals. The seventeen passive elements 8 are in specific positions so that they form a reflector profile in the form of a '+', with each component 4*a*, 4*b*, 4*c*, 4*d* located in a respective sector of the '+'. This reflector profile effectively divides the antenna arrangement 18 into four separate antennas, each antenna serving a respective sector A, B, C or D. When the active element components 4*a*, 4*b*, 4*c* and 4*d* emit radio signals in the desired band, the radio signals from each component are reflected in the directions indicated by arrows 20*a*, 20*b*, 20*c* and 20*d* respectively. Conversely, when the active element components 4*a*, 4*b*, 4*c* and 4*d* are for receiving radio signals, the configuration of the seventeen selected passive elements 8 allows only radio signals from a particular sector to be received by each component 4*a*, 4*b*, 4*c* and 4*d*.

It will be appreciated that the separation between respective passive elements 8 should, at a minimum, be of the order of the shortest operational wavelength. It should also be understood that the present disclosure addresses reconfigurable beam antennas that are synthesized in such a manner that the wavelength dependence is kept at a minimum. For example, a synthetic parabolic shape will only require a single active feeding element 4 located at the focus and therefore minimal wavelength dependence is ensured.

There is therefore provided an antenna arrangement for use in an ultra-wideband communications network that can be used in an omni-directional, directional or sectored configuration, and which can be rapidly changed from one configuration to the next.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim and "a" or "an" does not exclude a plurality. Any reference signs in the claims shall not be construed so as to limit their scope.

The invention claimed is:

1. An antenna arrangement for use in an ultra-wideband network, the antenna arrangement comprising:

an active element; and a plurality of passive elements arranged around the active element in a two-dimensional linear array, the two-dimensional linear array having a plurality of rows and a plurality of columns; each passive element being controllable to selectively reflect or transmit radio signals emitted by the active element so as to create a desired beam pattern from the active element.

2. An antenna arrangement as claimed in claim 1, wherein the active element comprises a single radiating element.

3. An antenna arrangement as claimed in claim 2, wherein the single radiating element is omni-directional.

4. An antenna arrangement as claimed in claim 1, wherein the active element comprises a plurality of radiating components.

5. An antenna arrangement as claimed in claim 4, wherein each radiating component emits a respective radio signal, and wherein the plurality of passive elements are controllable so as to create a respective beam pattern from each of the radiating components.

6. An antenna arrangement as claimed in claim 1, wherein each passive element comprises an electronically-controlled conductive polymer rod.

7. An antenna arrangement as claimed in claim 1, wherein one or more passive element comprises one or more switches distributed around its length, the one or more switches being selectively controllable to change the effective length of the passive element.

8. An ultra-wideband device comprising an antenna arrangement as claimed in claim 1.

9. An antenna arrangement for use in an ultra-wideband network, the antenna arrangement comprising:

an active element; and a plurality of passive elements arranged around the active element in a two-dimensional linear array, the two-dimensional linear array having a plurality of rows and a plurality of columns; each passive element being controllable to selectively reflect or transmit incident radio signals so as to direct radio signals from a desired direction or directions towards the active element.

10. An antenna arrangement as claimed in claim 9, wherein the active element comprises a single receiving element.

11. An antenna arrangement as claimed in claim 10, wherein the single receiving element is omni-directional.

12. An antenna, arrangement as claimed in claim 9, wherein the active element comprises a plurality of receiving components.

13. An antenna arrangement as claimed in claim 12, wherein the plurality of passive elements are controllable so as to direct radio signals from a respective direction or directions to a respective receiving component.

14. An antenna arrangement as claimed in claim 9, wherein each passive element comprises an electronically-controlled conductive polymer rod.

15. An antenna arrangement as claimed in claim 9, wherein one or more passive element comprises one or more switches distributed around its length, the one or more switches being selectively controllable to change the effective length of the passive element.

16. An ultra-wideband device comprising an antenna arrangement as claimed in claim 9.

17. A method of directing radio signals to or from an antenna in an ultra-wideband network, comprising:

providing the antenna with an active element;

arranging a plurality of passive elements around the active element in a two-dimensional linear array, the two-dimensional linear array having a plurality of rows and a plurality of columns;

controlling each passive element to selectively reflect or transmit radio signals emitted or received by the active element so as to create a desired beam pattern from or to the active element.

18. A method of directing radio signals as claimed in claim 17, wherein the active element comprises a single radiating element.

19. A method of directing radio signals as claimed in claim 18, wherein the single radiating element is omni-directional.

20. A method of directing radio signals as claimed in claim 17, wherein the active element comprises a plurality of radiating or receiving components.

21. A method of directing radio signals as claimed in claim 20, wherein each radiating component emits a respective radio signal, and wherein the plurality of passive elements are controllable so as to create a respective beam pattern from each of the radiating components.

22. A method of directing radio signals as claimed in claim 20, wherein each receiving component receives a respective radio signal, and wherein the plurality of passive elements are controllable so as to direct radio signals from a respective direction or directions to a respective receiving component.

23. A method of directing radio signals as claimed in claim 17, wherein each passive element comprises an electronically-controlled conductive polymer rod.

24. A method of directing radio signals as claimed in claim 17, wherein one or more passive element comprises one or more switches distributed around its length, the one or more switches being selectively controllable to change the effective length of the passive element.

* * * * *